US007712995B2

(12) United States Patent
Stadler

(10) Patent No.: US 7,712,995 B2
(45) Date of Patent: May 11, 2010

(54) METHOD OF CONTROLLABLY VENTING GASES GENERATED BY EXPLOSIONS IN A MANHOLE SPACE

(76) Inventor: David Stadler, 28421 Santa Barbara, Lathrup Village, MI (US) 48076

( * ) Notice: Subject to any disclaimer, the term of this patent is extended or adjusted under 35 U.S.C. 154(b) by 0 days.

(21) Appl. No.: 12/357,525

(22) Filed: Jan. 22, 2009

(65) Prior Publication Data

US 2009/0154993 A1 Jun. 18, 2009

Related U.S. Application Data

(62) Division of application No. 11/761,711, filed on Jun. 12, 2007, now Pat. No. 7,484,908.

(60) Provisional application No. 60/921,975, filed on Apr. 6, 2007, provisional application No. 60/889,553, filed on Feb. 13, 2007, provisional application No. 60/812,757, filed on Jun. 12, 2006.

(51) Int. Cl.
*E01C 3/06* (2006.01)

(52) U.S. Cl. ..... 404/72; 404/25

(58) Field of Classification Search ..... 404/25, 404/26, 72; 52/19, 20; 49/49
See application file for complete search history.

(56) References Cited

U.S. PATENT DOCUMENTS 822,562 A 6/1906 Tucker
2,025,839 A * 12/1935 Woods, Jr. ..... 49/21
2,363,567 A 6/1944 Blakeman
4,461,597 A * 7/1984 Laurin ..... 404/25
5,082,392 A * 1/1992 Marchese et al. ..... 404/25
5,312,202 A 5/1994 Newton
5,324,135 A 6/1994 Smith
5,845,442 A * 12/1998 Strehlow ..... 52/302.7
6,350,081 B1 * 2/2002 Khajavi et al. ..... 404/25
6,551,015 B1 4/2003 Khajavi et al.
7,243,515 B2 * 7/2007 Meyer ..... 70/269
2004/0244444 A1 * 12/2004 Wadsworth ..... 70/168
2005/0196238 A1 * 9/2005 DeGreef ..... 404/25

* cited by examiner

*Primary Examiner*—Raymond W Addie
(74) *Attorney, Agent, or Firm*—John R. Benefiel

(57) ABSTRACT

A method for controllably releasing venting gases from a manhole space around the perimeter of a manhole cover by allowing the manhole cover to rise up in stages upon development of upward forces in an explosion to vent gases developed by the explosion while being restrained from being completely blown free except under extreme conditions. A lock body mounts a latch slide which has an outer end and which can be extended to prevent removal of the manhole cover. When a shear pin fails the lock body pivots down, to a limited extent, and a secondary shear pin can also be included allowing the cover to be blown completely free upon development of pressures of a great magnitude. A slotted skirt is used to direct venting gas flow so as to retard the inflow of free air and attenuate the explosion.

4 Claims, 7 Drawing Sheets

METHOD OF CONTROLLABLY VENTING GASES GENERATED BY EXPLOSIONS IN A MANHOLE SPACE

CROSS REFERENCE TO RELATED APPLICATIONS

This application is a division of U.S. patent application Ser. No. 11/761,711 filed on Jun. 12, 2007, now U.S. Pat. No. 7,484,908, which claims the benefit of U.S. provisional patent applications No. 60/921,975 filed on No. Apr. 6, 2007; 60/889,553 filed on Feb. 13, 2007; and No. 60/812,757 filed on Jun. 12, 2006.

BACKGROUND OF THE INVENTION

This invention concerns mounting of manhole covers used to close off access to utility passages extending beneath city streets. For security purposes, it is desirable to limit access to such passages by locking the manhole covers onto their supporting seats.

However, manhole covers are sometimes subjected to very high pressures caused by explosions as when an accumulation of methane gas, etc. in the space below is ignited.

Manhole vault explosions usually blow the manhole covers out of their seats and into the air with great force. Since each manhole cover must be reinstalled as soon as possible after an explosion to cover up the hazardous open manhole, a significant maintenance cost is entailed.

Until a dislodged manhole cover can be replaced into its frame, the open manhole presents a serious hazard.

Pressure rises rapidly beneath a manhole cover in an explosion, and even a relatively small pressure rise will lift the manhole cover off its seat. For example, a momentary pressure rise of only one PSI beneath a 700 square inch manhole cover weighing 200 lbs. equates to a 500 lb. force available to dislodge the cover from its seat.

Although such explosive events are rare, when they do occur, manhole covers are often blown high into the air, can cause much damage, and even become deadly if a manhole cover strikes a passerby.

Typically, a metal manhole cover frame is cemented to the top of a manhole site chimney and set into the surrounding pavement.

A complicating factor is that the dislodging of the manhole cover acts to relieve gas pressure in the manhole during explosive events. Fixing manhole covers in place on their seats could cause damage to enclosing structures if there is no venting of the rapidly expanding gases. Pressure must somehow be relieved to avoid this potential structural damage.

It is an object of the present invention to provide a method which allows a controlled pressure relief while avoiding launching of the manhole cover out of its seat when an explosion occurs in the space beneath the cover.

SUMMARY OF THE INVENTION

The above recited object as well as other objects which will become apparent upon a reading of the following specification and claims are achieved by a method including mounting a lock body on the underside of a manhole cover at the perimeter thereof. A lug is mounted on the opposite side of the manhole cover so it can hook an inwardly sloping rim on the manhole seat defining structure.

The lock body is pivoted at one end between a pair of mounting plates by a swivel pin. Advance of the actuator bolt with a special wrench engages a leading end thereof with the cam surface on the latch slide to force the latch slide to move radially outward beyond the perimeter of the manhole cover. In that position, the latch slide will engage a sloping sidewall feature of the manhole cover enclosure when the cover is lifted up off its seat a short distance by the force of an explosion, creating a gap between the enclosure seat and the cover perimeter, allowing the venting of gas about the perimeter of the cover while preventing the manhole cover from being blown free.

The pivoted lock body may be restrained from pivoting down by a primary shear pin which will fail at a predetermined force level, allowing the lock body to pivot down a short distance where a stop engages a side of an enlarged opening in the lock body to prevent any further downward pivoting motion. This arrangement allows the cover to rise a predetermined short increment higher to create a greater venting area for the exit of explosive gases while still preventing the cover from being blown free.

The stop may be comprised of a secondary shear pin designed to also shear at a very high pressure level, allowing the lock body to swing down completely and let the manhole cover be blown free if very large pressures are experienced during the explosion which cannot be sufficiently relieved by the partial venting to prevent great structural damage.

According to another feature of the present invention, the manhole cover depending skirt extending around its perimeter is formed with scalloped slots shaped to redirect the exiting gases back toward the clearance gap around the cover, retarding the entrance of fresh air into the manhole and to attenuate the explosive combustion of the unburned gases which would otherwise occur. This reduces the magnitude of the peak pressure developed beneath the manhole cover from that which would otherwise develop.

DETAILED DESCRIPTION

In the following detailed description, certain specific terminology will be employed for the sake of clarity and a particular embodiment described in accordance with the requirements of 35 USC 112, but it is to be understood that the same is not intended to be limiting and should not be so construed inasmuch as the invention is capable of taking many forms and variations within the scope of the appended claims.

Figure 1:
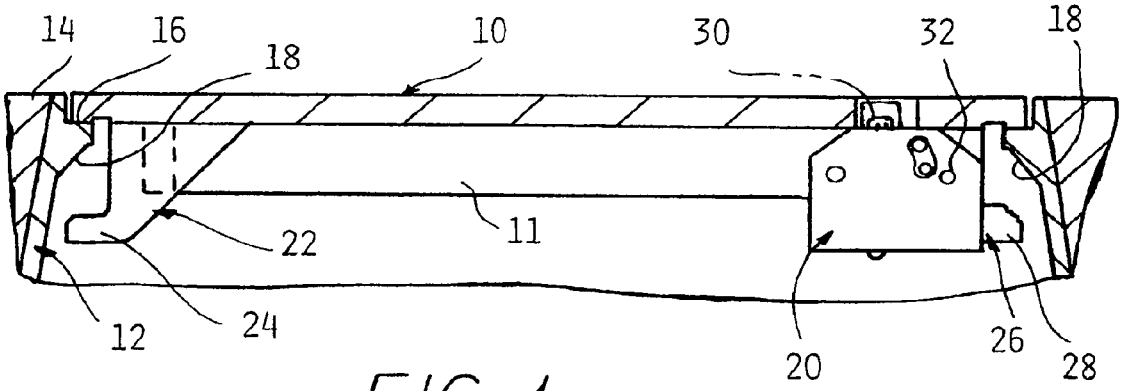
FIG. 1 is a fragmentary sectional view through a manhole metal enclosure and surrounding paving section with a manhole cover resting on a seat defined by the enclosure, having a security locking arrangement according to the present invention installed thereon including a lock body assembly and a fixed lug.

Referring to the drawings, FIG. 1 shows a manhole cover 10 resting on a seat 16 defined by a metal enclosure 12 recessed into street paving 14 and defining the manhole cavity itself. The enclosure 12 has an inwardly sloping annular feature 18 having the seat 16 defined on the top surface.

According to the present invention, a security locking arrangement is provided, comprised of a lock body assembly 20 fixed to the underside of the manhole cover 10 adjacent to the outer perimeter thereof in the space between two parallel extending ribs 11 extending across the underside of the cover 10. On the diametrically opposite side, a fixed lug 22 is integrally cast into the underside of the manhole cover 10 having an outwardly projecting portion 24 located to engage the sloping feature 18 when the manhole cover 10 is elevated off the seat 16 to a predetermined height.

The lock body assembly 20 includes a latching slide 26 which has an end portion 28 which will also engage the sloping feature 18 when extended out to the position shown in FIG. 1.

Figure 1A:
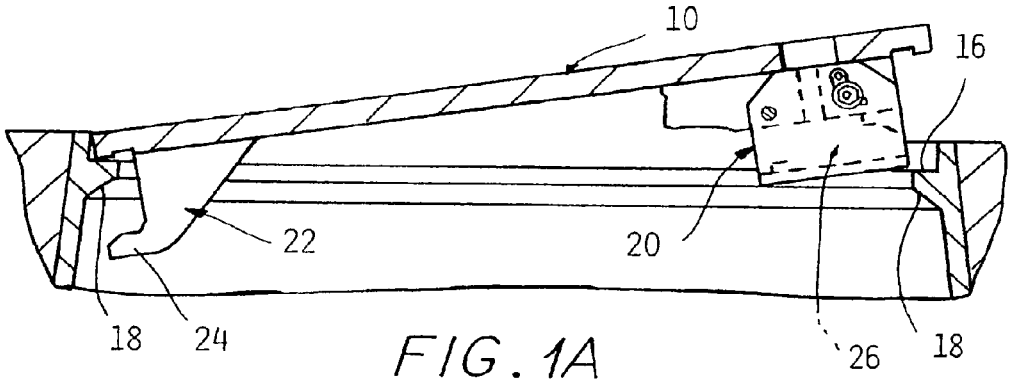
FIG. 1A is a view of the arrangement shown in FIG. 1 but with the manhole cover in the process of being installed.

FIG. 1A shows the latching slide 26 retracted within a lock body 34 for installation of the manhole cover 10 by angling it into the manhole opening within the enclosure 12. After seating the manhole cover 10, an actuator bolt 30 is advanced, as will be described below, to shift the latching slide 26 radially to the extended position shown in FIG. 1.

Figure 2:
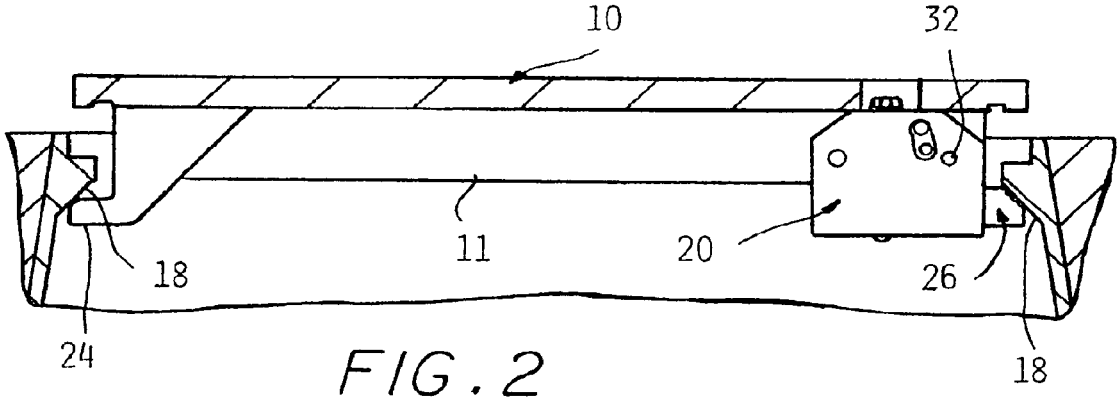
FIG. 2 shows the components shown in FIG. 1 with the manhole cover lifted as by the force of an explosion to bring fixed lug and latch slide portions into abutment with a sloping feature on the inside of manhole enclosure.

FIG. 2 shows the initial upward movement of the manhole cover 10 resulting from an explosion. The vertical space between the sloping surface 18 of the enclosure 12 and the lug portion 24 and latching slide portion 28 as seen in FIG. 1 allows the manhole cover 10 to lift up an inch or two before engagement of the portions 24, 28 with the enclosure feature 18. The resulting gap around the perimeter of the cover 10 allows the venting of the hot gases generated by the explosion.

Figure 3:
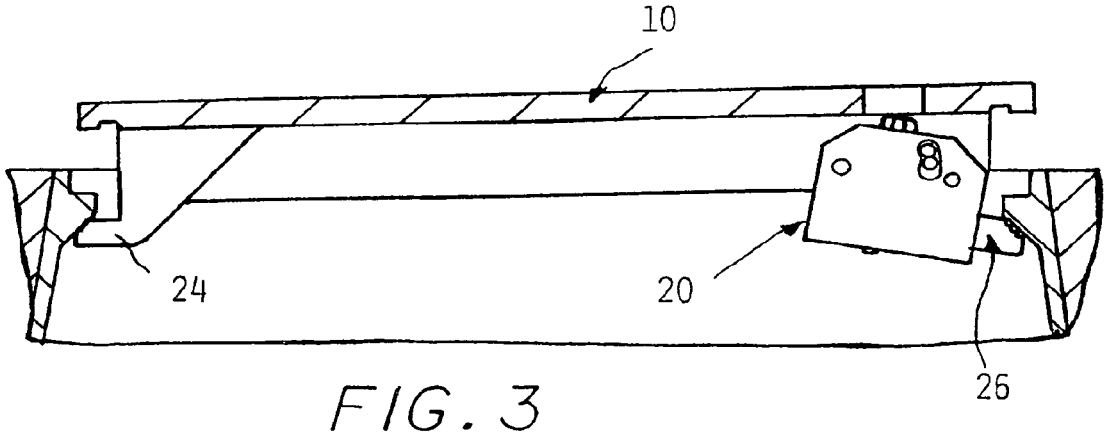
FIG. 3 shows the components shown in FIGS. 1 and 2 with the primary shear pin failed, resulting in a pivoting down of the lock body in turn allowing an additional incremental rise of the manhole cover off its seat to increase the area of the gap available for venting gases.

If the forces on the cover 10 created by the explosion exceed a predetermined level, a primary shear pin 32 holding the lock body 34 from pivoting about a pivot pin 36 will fail, allowing the lock body assembly 20 to pivot down to a shallowly angled position shown in FIG. 3. This creates another inch or so clearance about the perimeter of the cover 10 as seen in FIG. 3 such that the cover 10 can tilt up to open a larger gap, creating a staged additional venting area for the gases generated by the explosion so as to avoid structural damage by the development of high pressures in the manhole cavity.

Figure 4:
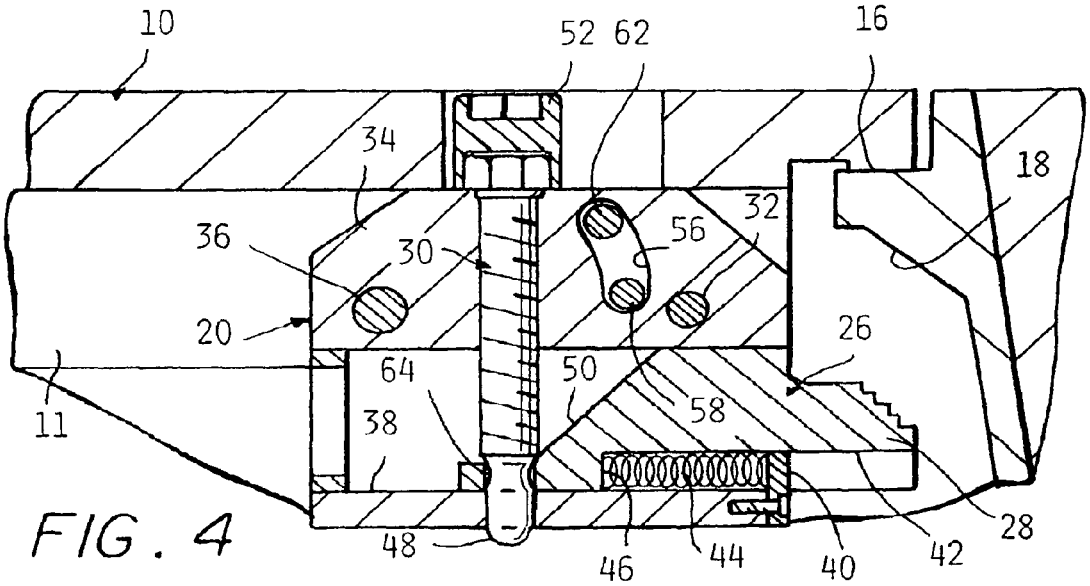
FIG. 4 is a fragmentary sectional enlarged view of the lock body and latch slide components, with adjacent portions of the manhole cover and enclosure.

FIG. 4 shows internal details of the lock body assembly 20. The lock body 34 is pivoted at one end on the pivot pin 36 received between vertical ribs 11 to allow limited rotation down from the cover 10 when the primary shear pin 32 also received in the ribs 11 is sheared off by the forces acting through the slide portion 28.

The latch slide 26 is slidably received in a bore 38 formed in the lock body 34. A keeper blade 40 is received in a slot 42 in the latch slide 26 to prevent rotation of the latch slide 26 within the bore 38.

A spring 44 interposed between keeper blade 40 and an end wall 46 of the slot 42 urges the latch slide 26 to the left to tend to retract the portion 28 radially inwardly.

The actuator bolt 30 has a rounded end 48 which engages a sloping cam surface 50 on the top of the latch slide 26 which forces the latch slide 26 to the right when the bolt 30 is rotated to be advanced until the fully advanced position is reached as seen in FIG. 4. The bolt can be turned using an anti-tamper special wrench tool 52 mating with a correspondingly specially shaped bolt head 51 to prevent unauthorized removal of the manhole cover 10. Such a tool and bolt head is described in U.S. Pat. No. 6,764,261. A plug 60 can enclose the bolt head 51 for protection and to keep debris from filling the recess within the cover 10 accommodating the bolt head 51.

A retainer ring 54 is fixed at one of the bore 38 preventing escape of the latch slide 26 to the left when the actuator bolt 30 is removed.

Figure 5:
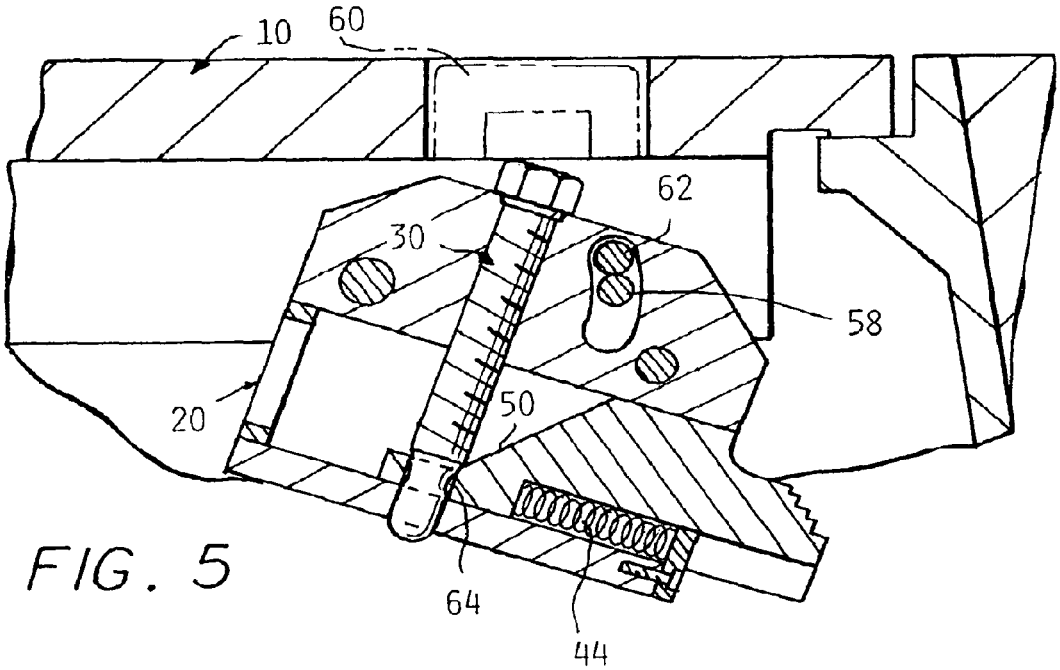
FIG. 5 is a view of the components shown in FIG. 4 with the lock body pivoted down a short distance.

A stop pin 58 is received in an elongated arcuate slot 56. When the primary shear pin 32 releases, the latch body 34 pivots down a short distance until a bumper 62 contacts stop pin 58 in the position shown in FIG. 5 preventing further pivoting.

The actuator bolt 30 has an annular curved shaped groove 64 near its end which is positioned in a hole in a flat at the end of the latch slide 26. This allows the latch slide 26 to be moved slightly further to the left by the spring 44 when the bolt 30 is fully advanced. When the bolt 30 is withdrawn, a slight camming action by the curved side of the groove 64 breaks the slide 26 free if ice or corrosion has developed seizing the latch slide 26 in the bore 38 allowing the spring 44 to again act to retract the latch slide 26 with portion 28 to enable removal of the manhole cover 10.

Figure 7:
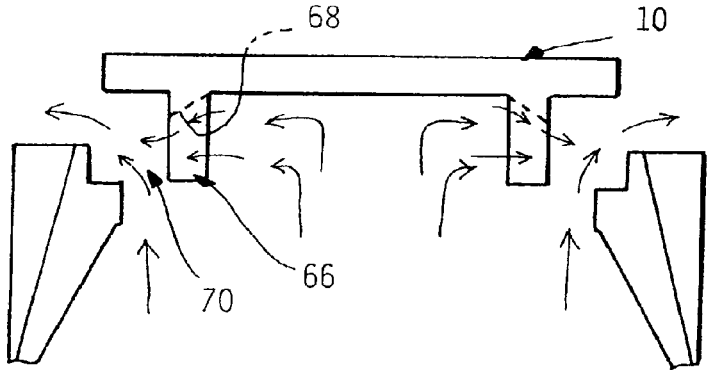
FIG. 7 is a diagrammatic representation of the gas flow past the manhole cover in an explosion illustrating the redirection of gas flow induced by scalloped slots in the skirt on the inside of the manhole cover.
Figure 6:
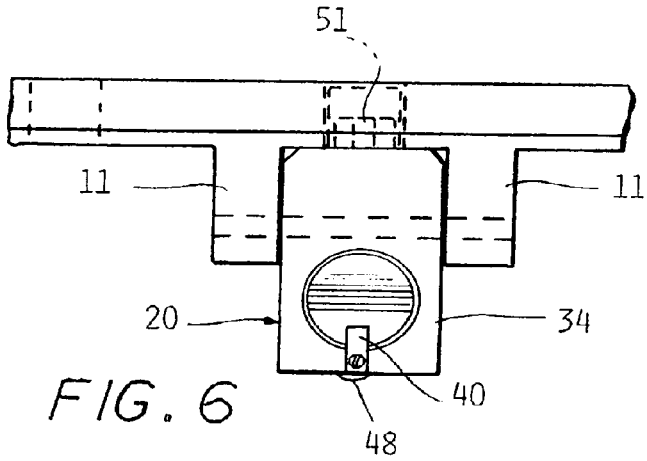
FIG. 6 is a fragmentary view of the manhole cover showing an end view of the lock body assembly components.
Figure 8:
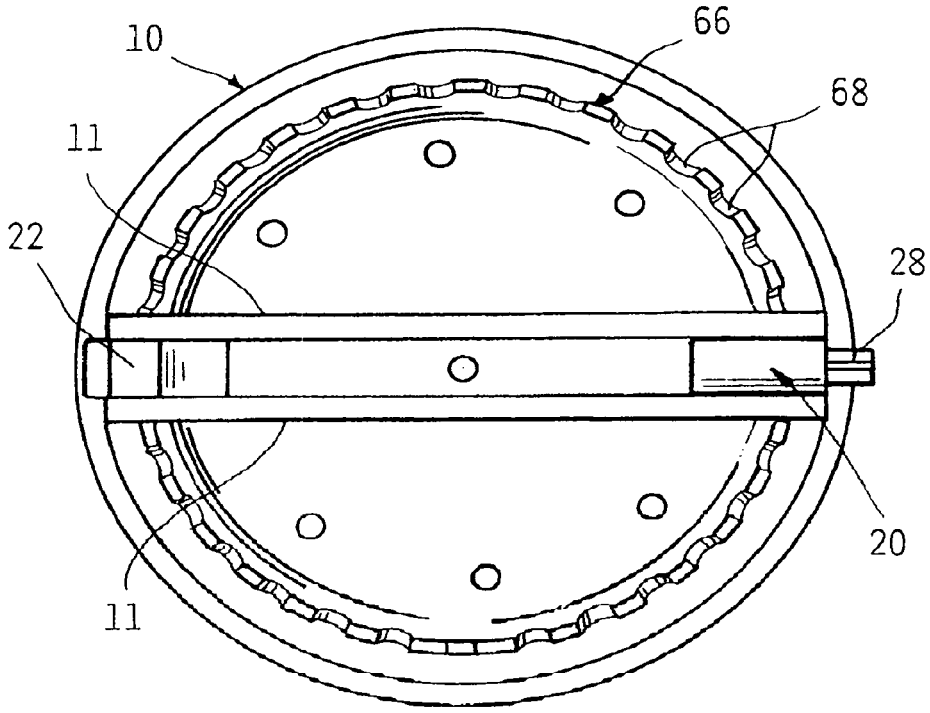
FIG. 8 is a plan view of the bottom of the manhole cover showing the slotted skirt and the lock arrangement components.
Figure 8A:
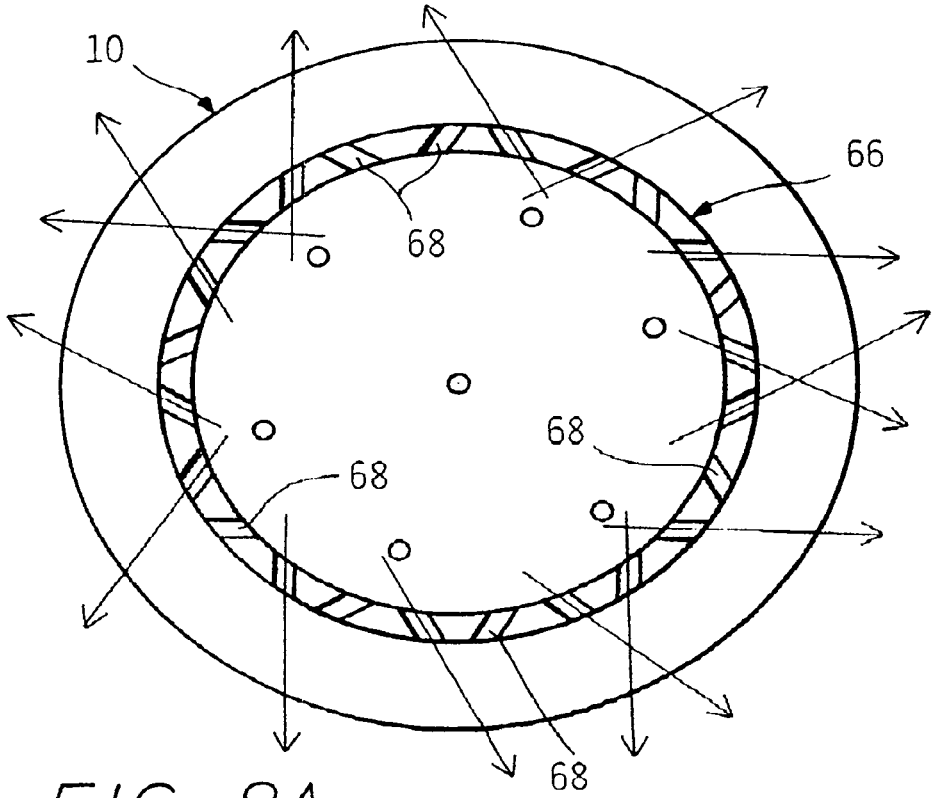
FIG. 8A is a diagrammatic representation of the gas flow path induced by the slots.

During a manhole explosion, a high velocity flow of gases are directed against the under side of the manhole cover 10. The high velocity gases thus produced fill a cup shaped cavity defined by a skirt 66 usually cast as an integral part of the manhole cover 10 for strengthening purposes (FIGS. 7 and 8). The cavity defined by the skirt 66 when filled with high velocity gases helps to propel the cover 10 out of enclosure 12 during a manhole explosion. According to another feature of the invention, the skirt 66 is formed with scalloped slots 68 comprising a plurality of semi-circular openings. The scalloped slot surfaces are angled down at between 30° and 45° and are also radially canted between 30° and 45° from alignment with the axis of the manhole cover 10. The canting of the slots 68 are reversed from each of the adjacent slots 60 to maximize swirl in the vertical pressure wave outside skirt 66 (FIG. 8A). The skirt portions between the slots 68 disrupt and diffuse the radial pressure wave created when vertical pressure wave within the skirt 66 is forced to turn 90° and exit at high velocity radially.

The slots 68 direct high pressure gases radially into the advancing vertical flame front outside the skirt 66. Consequently, the vertical flame front outside the slotted skirt 66 is disrupted and diffused.

Angular pressure waves are shaped and directed by the slots 68 into the vertical column of expanding gases outside the skirt 66. These actions disrupt laminar gas flow axially and radially by generating diffusion in these respective flame fronts. Diffusion induces swirl and tumble in the respective air masses, lowers temperatures, and shortens radial flame travel on street surface. Shortened flame travel lessens injury potential to pedestrians near manhole explosions.

Figure 9:
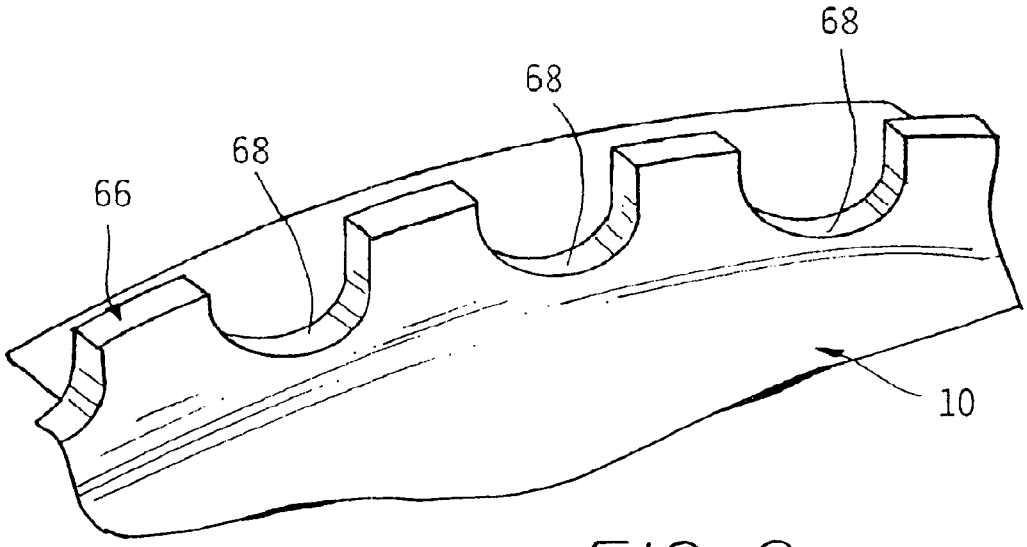
FIG. 9 is an enlarged fragmentary view of a portion of the slotted skirt on the manhole cover.

According to another aspect of this feature, a flow retarding action is created by the slotted skirt 66 extending below the underside of the cover 10 (FIGS. 7-9). A portion of the expanding gases from an explosion in passing through the series of downwardly angled slots 68 are directed down into the gap 70 where the outflow of gas occurs. This creates turbulence and an increased static pressure which retards the inflow of fresh air. This in turn attenuates the continued burning of the flammable gases such as methane to reduce the peak force of the explosion by reducing the amount of available oxygen to combust the flammable gases.

Figure 9A:
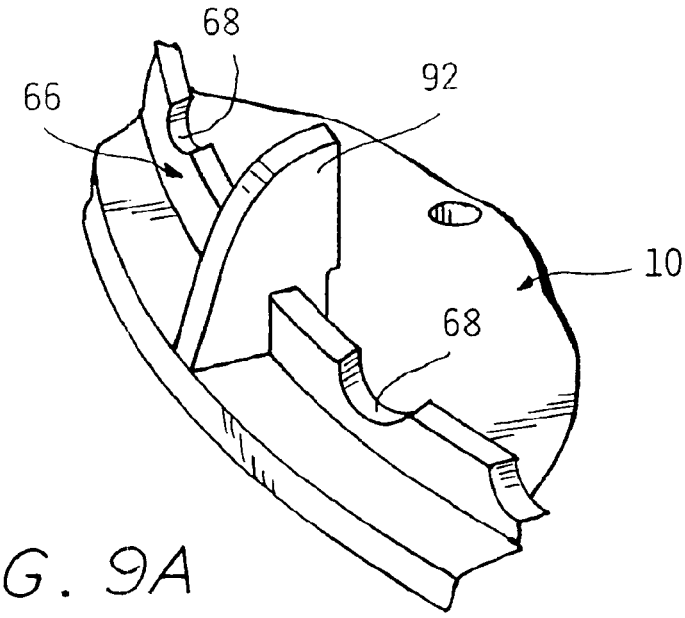
FIG. 9A is an enlarged fragmentary view of another portion of the slotted skirt showing a centering guide.
Figure 10:
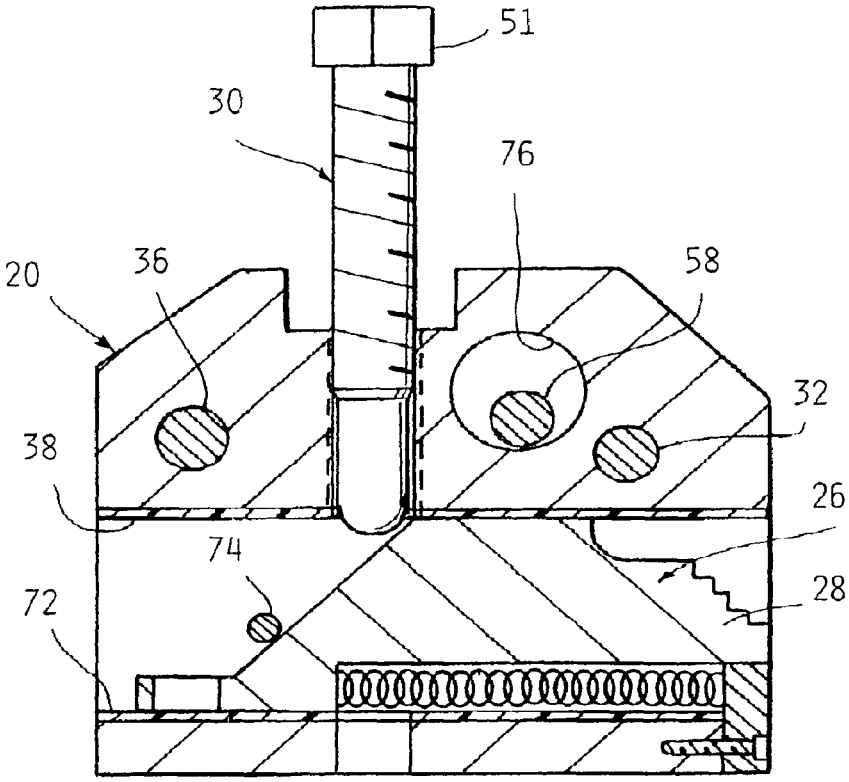
FIG. 10 is a sectional view of a modified form of the lock body assembly.

A series of centering guides 92 (FIG. 9A) are affixed around the outer perimeter of the cover to insure that the cover 10 will drop back into the seat 16 after the pressure returns to normal.

FIGS. 10-14 shows some modifications in the lock body assembly 20. A plastic liner sleeve 72, as of Teflon, may enclose the slide bore 38 to prevent seizing and insure free movement of the latch slide 26 therein. A stop roll pin 74 may be used to limit travel of the latch block 26 to the left instead of the retainer ring 54.

An enlarged bore 76 provides the stop for the secondary shear pin 58, an easier feature to machine than the arcuate slot 56 described above.

Figure 11:
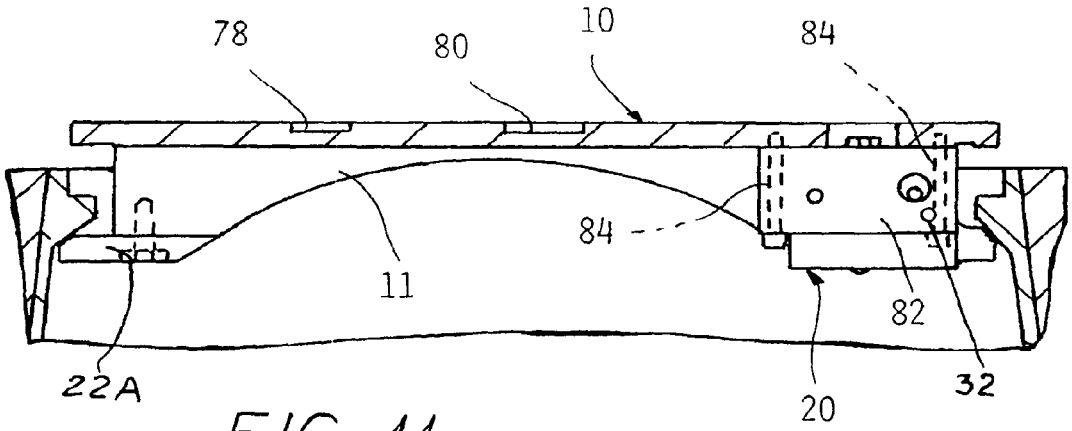
FIG. 11 is a partially sectional view of a portion of a manhole frame with a manhole cover having a modified form of the lock body assembly mounted thereto.

The integrally cast reinforcement ribs 11A can be reduced in height at the middle by a radiused contour as seen in FIG. 11.

An RFID "sparse pulse" transmitter 78, solar battery/charger 80 can be included (FIG. 11) for detecting an explosion event or unauthorized cover removal at a monitoring station.

The lock body assembly 20 can be mounted on detachable retainer plates 82 secured to the underside of the cover with bolts 84 received in threaded holes in the cover rather than directly to the ribs 11. This allows the entire assembly to be manufactured and assembled separately from the cover 10, and to be easily installed or removed. In that case, the opposite ends of the pivot pin 36 can be captured in respective blind holes formed in the two plates 82. Also, the lug 22A can be a separate piece attached to ribs 11 with screws as shown.

The stop 58 can be designed to act as a secondary shear pin, which when sheared will release the lock body assemble 20 to pivot down to a sharply angled position (FIG. 14), allowing the cover 10 to blow free in the event of a very powerful explosion of a magnitude that could still create great damage despite being partially vented.

Figure 12:
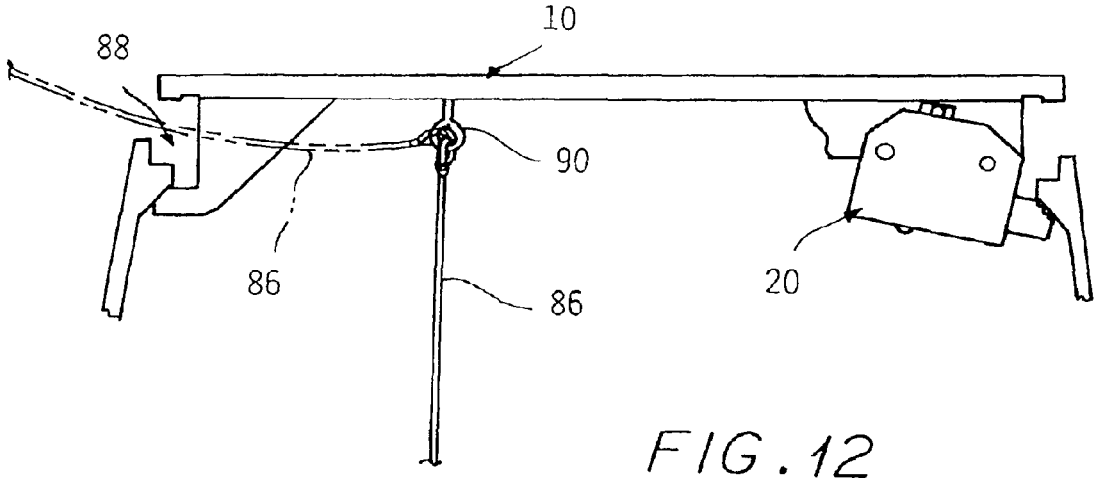
FIG. 12 is an inside view of the manhole cover having an explosion indicator rope hung from the inside of the manhole cover.
Figure 13:
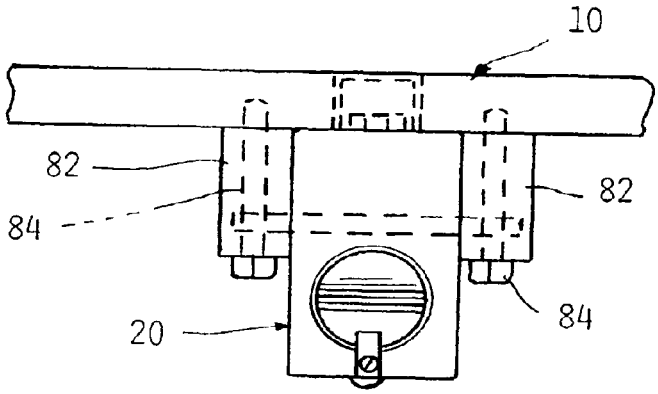
FIG. 13 is an end view of the components shown in FIG. 11.
Figure 14:
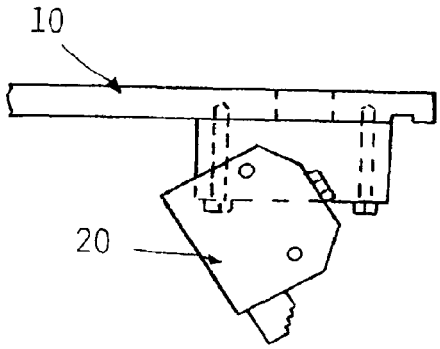
FIG. 14 is a side view of the lock body assembly in the fully pivoted down position completely releasing the manhole cover.

FIG. 12 shows an indicator rope or strip 86 hung on an eye 90 which strip 86 will be blown out through the gap 88 in an explosion with a tag on end of rope (danger call utility). This will enable maintenance crews to be alerted to the fact that an explosion has occurred at the site of a particular manhole after the cover 10 has dropped back into its normal position.

The invention claimed is:

1. A method of controllably venting gases generated by explosions in a manhole space having a manhole cover extending over said manhole space received within an opening in a frame structure, comprising:

arranging locking features on a perimeter of said manhole cover spaced apart from each other and extending radially outwardly to be aligned beneath portions of a said frame structure extending around said opening and with a vertical clearance between said locking features and said portions of said structure so as to allow said manhole cover to rise up in the event of an explosion to clear said structure and thereby create an annular gap between the underside of the cover and the top of said structure allowing venting of gases from said manhole space; and preventing further vertical movement of said manhole cover by interengagement of said locking features and said structure portions upon continued upward vertical movement of said manhole cover to thereby prevent said manhole cover from being blown completely free of said structure and able thereafter to drop down over said opening in said frame structure.

2. The method according to claim 1 further including selectively radially retracting at least one of said cover locking features to prevent said interengagement of said cover locking feature with said aligned structure portions to allow complete removal of said manhole cover from said opening.

3. The method according to claim 2 further including releasably mounting a lock body carrying one of said locking cover features to said manhole cover so as to allow movement downwardly of said one of said cover features upon application of an upward force on said manhole cover of a predetermined magnitude so as to allow further rise of said manhole cover to create a increased perimeter gap between said manhole cover and said structure allowing a staged increased area venting of gases from within said manhole space.

4. The method according to claim 1 further including forming said manhole cover with a perimeter skirt depending from the inside thereof and forming a series of scalloped slots contoured to redirect the out flow of gases created during an explosion downwardly towards said gap to so as retard inflow of air in an explosion to reduce the oxygen available to feed combustion of sewer gases creating said explosion.

* * * * *